US006617974B2

(12) United States Patent
Stanek

(10) Patent No.: US 6,617,974 B2
(45) Date of Patent: Sep. 9, 2003

(54) MULTIPLE POLE FUSED DISCONNECT

(76) Inventor: Dan Stanek, 714 W. Barry, Chicago, IL (US) 60657

( * ) Notice: Subject to any disclaimer, the term of this patent is extended or adjusted under 35 U.S.C. 154(b) by 0 days.

(21) Appl. No.: 09/865,156

(22) Filed: May 24, 2001

(65) Prior Publication Data

US 2002/0175823 A1 Nov. 28, 2002

(51) Int. Cl.[7] ..... G08B 21/00
(52) U.S. Cl. ..... 340/638; 340/639; 361/104
(58) Field of Search ..... 340/638, 639; 337/186, 187, 189, 198; 361/104, 117, 118, 119; 324/133, 123, 74

(56) References Cited

U.S. PATENT DOCUMENTS 3,778,740 A * 12/1973 Gaia et al. ..... 337/187
5,355,274 A 10/1994 Marach et al.
5,361,026 A * 11/1994 Pruehs et al. ..... 324/74
5,559,662 A * 9/1996 Happ ..... 361/104
5,841,337 A * 11/1998 Douglass ..... 337/198
5,963,411 A 10/1999 Mollet et al.

FOREIGN PATENT DOCUMENTS

GB 2365228 * 2/2002

* cited by examiner

*Primary Examiner*—Van Trieu
(74) *Attorney, Agent, or Firm*—Bell, Boyd & Lloyd LLC

(57) ABSTRACT

The present invention provides an improved fused disconnect. More specifically, the present invention provides a fusible disconnect that includes a single line side terminal, two independent load side terminals, two independent removable fuse carriers and two independent blown fuse indicators. The common line side terminal provides power to both of the removable fuse carriers. The present invention therefore enables a single, standard sized disconnect to isolate and provide overload protection for two electrical load devices, thus reducing the required number of fused disconnects by one half. The present invention also reduces the required number of line side connections by one half. To this end, in an embodiment of the present invention, a multiple pole fused disconnect includes a housing, a line terminal secured to the housing and a plurality of load terminals secured to the housing. The fused disconnect also includes a pair of fuses each electrically communicating with the line terminal and a load terminal.

18 Claims, 3 Drawing Sheets

MULTIPLE POLE FUSED DISCONNECT

BACKGROUND OF THE INVENTION

1. Field of the Invention

The present invention relates, generally, to fuse-protected electrical disconnects for power distribution systems. More particularly, the present invention relates to low voltage, high current electrical disconnects having load side and line side terminals.

2. Description of the Prior Art

Power distribution systems, such as those used in telecommunications applications, often need to deliver low voltage but high current electrical power to devices that require this power to operate. These power systems must provide uninterrupted operation and usually rely on batteries to supply instantaneous back-up power if necessary. In these systems, it is sometimes necessary to disconnect power to various pieces of equipment, or small groups of equipment, so that operators can perform maintenance. It is also necessary to provide overload protection for the equipment on an individual basis, so that operators can diagnose malfunctioning electrical devices.

For these reasons, multiple levels of power distribution are used with larger fused disconnects feeding smaller fused disconnects. For example, a single large fused disconnect, ranging in operation from 600 to 1200 Å, can distribute power to many smaller fused disconnects having loads in the range of 1 to 90 Å in normal operation. Each of these smaller loads should have their own disconnect as well, so that operators can perform maintenance on a specific load device without interrupting the operation of other load devices. Large power distribution systems including telecommunications systems, which supply many electrical devices, therefore require many individual fused disconnects.

Power system enclosures or power distribution frames are designed to receive a standard sized fused disconnect, which is approximately one inch wide by five inches high. Known fused disconnects typically include a housing having, among other items, a line side terminal connected to a power supply line bar, a single load side terminal that enables an electrical connection to a single load device and a single removable plug-in fuse carrier. Some known disconnects also provide an alarm circuit connected in parallel with the main fuse. The alarm circuit provides either local or remote blown fuse indication.

The cumulative effect of these standard sized disconnects is that they take up a large amount of valuable space within the power system enclosure or distribution frame. Typical enclosures, housing up to 128 individual disconnects in a row, fill up quickly. Furthermore, properly maintained large power systems leave adequate room for additional load devices. Since the size of the disconnect housing has been standardized and distribution frames have been fabricated according to the space requirements of such housings, a need exists to optimize the design of existing disconnect assemblies.

SUMMARY OF THE INVENTION

The present invention provides an improved fused disconnect. More specifically, the present invention provides a fusible disconnect that includes a single line side terminal, two independent load side terminals, two independent removable fuse carriers and two independent blown fuse indicators. The common line side terminal provides power to both of the removable fuse carriers. The present invention therefore enables a single, standard sized disconnect to isolate and provide overload protection for two electrical load devices, thus reducing the required number of fused disconnects by one half. The present invention also reduces the required number of line side connections by one half.

To this end, in one embodiment of the present invention, a multiple pole fused disconnect housing includes a line terminal, a plurality of load terminals and a pair of fuse connectors for each load terminal. Each pair of fuse connectors is adapted to receive a fuse.

In an embodiment, the housing has a cavity associated with each pair of fuse connectors and each cavity is adapted to receive a fuse. In an embodiment, the fuses are housed in a carrier and each cavity is adapted to receive a fuse carrier.

In an embodiment, the housing is physically dimensioned to require no more mounting space on a standard power distribution frame than does a standard single fuse housing.

In an embodiment, each pair of connectors electrically communicates with the line terminal and a load terminal. In an embodiment, one connector of each pair electrically communicates with a blown fuse indicator. In an embodiment, the blown fuse indicator includes a light emitting diode.

In another embodiment of the present invention, a multiple pole fused disconnect includes a housing, a line terminal secured to the housing and a plurality of load terminals secured to the housing. The fused disconnect also includes a pair of fuses each electrically communicating with the line terminal and a load terminal.

In an embodiment, the line terminal electrically communicates with a blown fuse indicator. In an embodiment, the fuses are housed in a carrier.

In an embodiment, the housing has a cavity associated with each fuse, wherein the cavities are each adapted to receive either a fuse or a fuse carrier. In an embodiment, the housing has a cavity associated with each fuse, wherein the cavities are each adapted to receive identically sized carriers.

In an embodiment, the fuses have different current ratings. In an embodiment, the fuses have current ratings from one to ninety amps.

In an embodiment, the fuses include blown fuse indicators. In an embodiment, the fuse carriers include fused alarm switches in electrical communication with the fuses.

In an embodiment, the housing is physically dimensioned to require no more mounting space on a standard power distribution frame than does a standard single fuse housing.

In an embodiment, the housing includes a plurality of pairs of fuse connectors, each pair of fuse connectors adapted to electrically communicate with a fuse. In an embodiment, the housing includes a plurality of pairs of conductive clips, each pair of clips adapted to press-fit onto a pair of fuse contacts associated with the fuse.

In a further embodiment of the present invention, a method of providing fuse-protected electrical disconnects for a plurality of individual load-side devices in a power distribution system includes the following steps. An operator connects a single industry-standard size electrical disconnect housing to a power distribution frame, wherein the housing includes one line terminal and a plurality of load terminals. The operator connects a plurality of fuses to the housing, wherein each of the plurality of fuses is in electrical communication with the line terminal and a respective one of the plurality of load terminals. The operator connects the line terminal to line-side power. The operator lastly connects each of the plurality of load terminals to a respective one of the plurality of individual load-side devices.

In this method, the space required along the power distribution frame for the housing is no greater than the space required for a single industry-standard size electrical disconnect. That is, the housing of the present invention requires the same space as those disconnects providing only one line terminal and only one load terminal and being adapted to connect only one fuse therebetween.

An advantage of the present invention is to provide double the amount of electrical devices that can be connected to a standard sized fused disconnect.

Another advantage of the present invention is to reduce the number of required load side connections in a power distribution frame by one half.

A further advantage of the present invention is to provide a housing that is compatible with existing enclosures or power distribution frames.

Yet another advantage of the present invention is to provide individual blown fuse indication for each fuse, as well as to isolate secondary fuse alarms from the housing to reduce the frequency of false alarms.

Additional features and advantages of the present invention will be described in, and apparent from, the following Detailed Description of the preferred embodiments and the Drawings.

DETAILED DESCRIPTION OF THE PREFERRED EMBODIMENTS

Figure 1:
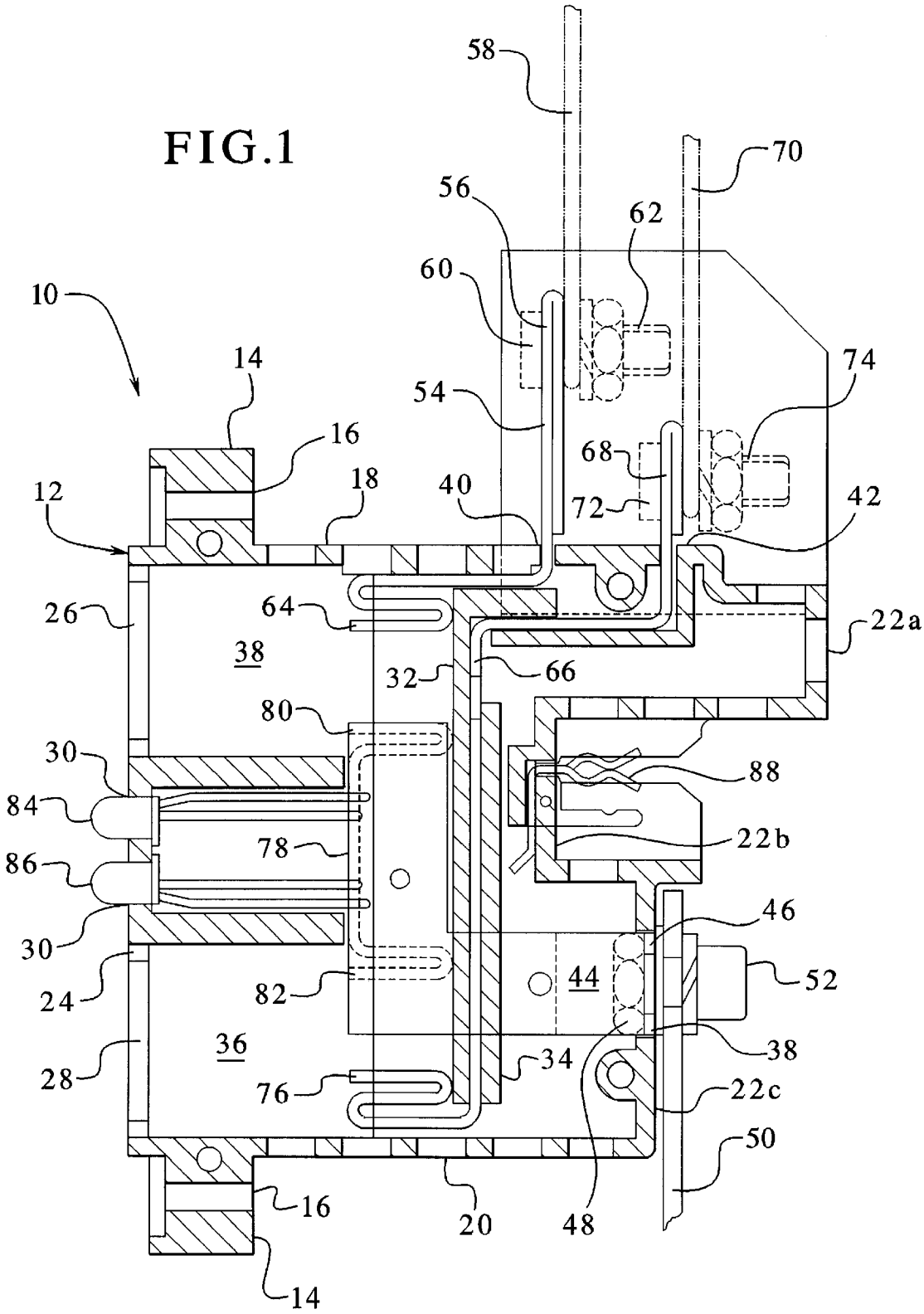
FIG. 1 is an elevation sectional view of one embodiment of the multiple pole fused disconnect of the present invention.

Referring now to the drawings and in particular to FIG. 1, one embodiment of the multiple pole fused disconnect 10 of the present invention is illustrated. The disconnect 10 includes a housing 12 having a pair of mounting flanges 14, which define a pair of mounting holes 16. The housing 12 is preferably made of an electrically insulative, flame retardant plastic such as glass-filled polyester. The flanges 14 and mounting holes 16 are preferably formed to enable the disconnect 10 to be conveniently mounted in conventional enclosures or power distribution frames for large power systems. The dimensions of the housing 12 and the footprint defined by the mounting holes 16 preferably comply with industry standards and most preferably enable circuit breakers to be easily replaced. In one embodiment, the mounting holes are sized for a No. 6 screw.

The plastic housing 12 includes a top wall 18, a bottom wall 20 and a number of back walls 22*a* through 22*c*, which are disposed at different horizontal dimensions from a front wall 24. The different horizontal dimensions of the back walls 22*a* through 22*c* facilitate the housing of various components of the disconnect 10 and the electrical connection of associated wires. Meanwhile, the front wall 24 remains substantially flat for operator viewing and for fuse carrier insertion and removal.

The front wall 24 defines a number of apertures 26 and 28, through which the operator inserts or removes the fuse carriers. While the present embodiment illustrates two apertures 26 and 28, for two fuse carriers, the present invention is not limited to two and alternatively provides three or more apertures for three or more fuse carriers. The front wall further defines a plurality of apertures 30. The apertures 30 receive a plurality of blown fuse indicators. The operator readily sees the blown fuse indications, which face outward from the front wall 24.

The housing 12 includes a number of inner walls 32 and 34. The inner walls 32 and 34 are preferably insulative plastic and electrically isolate different conductive materials within the housing 12. The inner walls 32 and 34 also provide support for the conductive materials during and after assembly of the housing 12. The housing 12, which includes one or more molded plastic pieces, is adaptable such that one or both or a portion of one or both of the inner walls 32 and 34 are integrally formed with the outer walls of the housing. The housing 12 is further adaptable to be molded via any known technique.

The housing 12 includes side walls 36 (one illustrated in section view), which together with the apertures 26 and 28, defined by the front wall 24, form insulated plastic cavities within which the fuse carriers slide into and become housed. The back wall 22*c* defines an aperture 38, through which the disconnect 10 electrically communicates with a line wire. The top wall 18 defines apertures 40 and 42, through which the disconnect 10 electrically communicates with a number of load wires.

The housing 12 includes a conductive line conductor 44, which in one embodiment is made of copper or copper alloy. The line conductor 44 is adaptable to be made of a single piece of conductive material or to include a number of fused or otherwise fixed conductive pieces. One end of the line conductor 44 terminates and defines a line terminal 46. The line terminal 46 provides any known form of electrical connection including soldering posts and quick disconnects. In one preferred embodiment, the line terminal 46 provides an aperture and a lug nut 48. The operator electrically connects a line wire 50 to the line terminal 46 by compressing the line wire 50, or a suitable connector attached thereto, between the lug nut 48 and a lockwasher and screw 52.

The opposing end of the line wire 50 terminates with an electrical connection to the line bar power supply (not illustrated) located within the power distribution enclosure or frame. The line wire 50 is appropriately sized to handle the accumulated current of the multiple pole outputs and therefore may be of a thicker gage than the load wires. The line wire 50 is preferably copper or copper alloy stranded wire, which is suitably electrically insulated.

The housing 12 includes a first conductive load device conductor 54, which in one embodiment is made of copper or copper alloy. The first load conductor 54 is adaptable to be made of a single piece of conductive material or to include a number of fused or otherwise fixed conductive pieces. In one preferred embodiment, the first load conductor 54 is suitably bent from one piece of metal to provide a desired shape and rigidity for electrically connecting to various devices. One end of the first load conductor 54 terminates and defines a first load terminal 56. The first load terminal 56 again includes any known form of electrical connection and preferably defines an aperture. The operator electrically connects a first load wire 58 to the first load terminal 56 by compressing the first load wire 58, or a suitable connector attached thereto, between a screw 60 and a lockwasher and nut 62.

The opposing end of the first load wire 58 terminates with an electrical connection to a first electrical device or load device. The first load device can have a fuse rating of between one and ninety amps. This range covers most electrical applications from, but not including, the circuit board level up to and including electric motors and the like. The first load wire 58 is appropriately sized to handle the load current required by the electrical device. The first load wire 58 is preferably copper or copper alloy stranded wire, which is suitably electrically insulated.

The opposing end from the first load terminal 56 on the first load conductor 54 defines a fuse connector or clip 64, which is adapted to receive and removably hold a plug contact from a fuse carrier. The first load conductor 54 is adaptable to provide different devices for receiving the carrier plug contact. In one preferred embodiment, fuse connector the clip 64 includes a number of bends or folds at the end of the conductor 54, which create a U-shaped conductive insert for the carrier plug contact. The U-shaped fuse connector clip 64 is adaptable to be bent slightly past 180 degrees so that the walls of the U-shape spread apart upon insertion of the carrier plug contact. In this manner, the U-shaped fuse connector clip 64 press-fits onto the plug contact and removably holds the carrier in place.

The housing 12 also includes a second conductive load device conductor 66, which is also copper or copper alloy. In one preferred embodiment, the second load conductor 66 is suitably bent from one piece of metal to provide a desired shape and rigidity. One end of the second load conductor 66 terminates and defines a second load terminal 68, which preferably defines an aperture. The operator electrically connects a second load wire 70 to the second load terminal 68 by compressing the second load wire 70, or suitable connector attached thereto, between a screw 72 and a lockwasher and nut 74. The second load terminal 68 is preferably vertically or horizontally disposed away from the first load terminal 56, e.g. one inch (25.4 mm), such that the operator can readily access both terminals.

The opposing end of the second load wire 70 terminates with an electrical connection to a second electrical or load device. The second load device also can have a fuse rating of between one and ninety amps. The second load wire 70 is appropriately sized thereto and is preferably an electrically insulated copper or copper alloy stranded wire. The second load device can have the same, slightly different or substantially different load current than the first device. The first and second load wires 58 and 70 can also run in parallel in the same circuit.

The opposing end from the second load terminal 68 on the second load conductor 66 also defines a fuse connector clip 76 for removably holding a carrier plug contact. As above, the fuse connector or clip 76 preferably includes a number of bends or folds at the end of the conductor 66, which create an overly bent U-shaped copper or copper alloy conductive insert for the fuse carrier plug contact. The U-shaped fuse connector or clip 76 also press-fits onto a fuse carrier plug contact and removably holds the carrier in place.

The housing 12 further includes a conductor 78, which is likewise copper or copper alloy. In one preferred embodiment, the conductor 78 is integrally formed with, fused to or otherwise fixed to and in electrical communication with the line conductor 44. The ends of the conductor 78 define copper or copper alloy fuse connectors clips 80 and 82 for removably holding a fuse carrier plug contact. As above, the fuse connectors or clips 80 and 82 preferably include a number of bends or folds at the end of the conductor 78, which create an overly bent U-shaped conductive insert for the fuse carrier plug contact. The fuse connectors or clips 80 and 82 likewise press-fit onto the carrier plug contact.

It should be appreciated that the cavity defined by side walls 36 and the aperture 26 contains a pair of clips along the inner insulated wall 32 of the cavity. When the operator slides a fuse carrier into the aperture 26, the plug contacts of the carrier eventually mate with the clip 64 of the first load device conductor 54 and the fuse connector or clip 80 of the conductor 78 (in electrical communication with the line conductor 44), respectively. Further, the cavity defined by side walls 36 and the aperture 28 contains a pair of clips along the inner insulated wall 32 of the cavity. When the operator slides a fuse carrier into the aperture 26, the plug contacts of the carrier eventually mate with the clip 76 of the second load device conductor 66 and the fuse connector or clip 82 of the conductor 78, respectively.

A pair of blown fuse indicators 84 and 86 are mounted to the front wall 24 of the housing 12 via the apertures 30. The indications provided by the blown fuse indicators 84 and 86 preferably emanate away from the front wall 24, so an operator easily sees them. The present invention provides any type of blown fuse indicator currently known in the art. The blown fuse indicators 84 and 86 of the present invention are also adaptable to include separately fused alarm outputs, such as the springing or "grasshopper" type of alarm switch. In this instance, the disconnect 10 provides an alarm contact 88, illustrated here disposed in the back wall **22*b***. It has been observed, however, that such devices when installed separately from the fuse carriers can cause false alarms if the operator removes the fuse carrier, i.e., intentionally creating an alarm condition, without first disabling the alarm fuse.

Consequently, the blown fuse indicators 84 and 86 in one preferred embodiment include indicators, such as light emitting diodes (LED's) but do not include an alarm switch. In an alternative embodiment (not illustrated), the removable fuse carriers are adaptable to include fused alarm switches, which close a contact that is in electrical communication with the alarm contact 88. In this case, when the operator removes the fuse carrier, i.e., intentionally creating an alarm condition, the fused alarm comes with the carrier so that no false tripping occurs.

Figure 2:
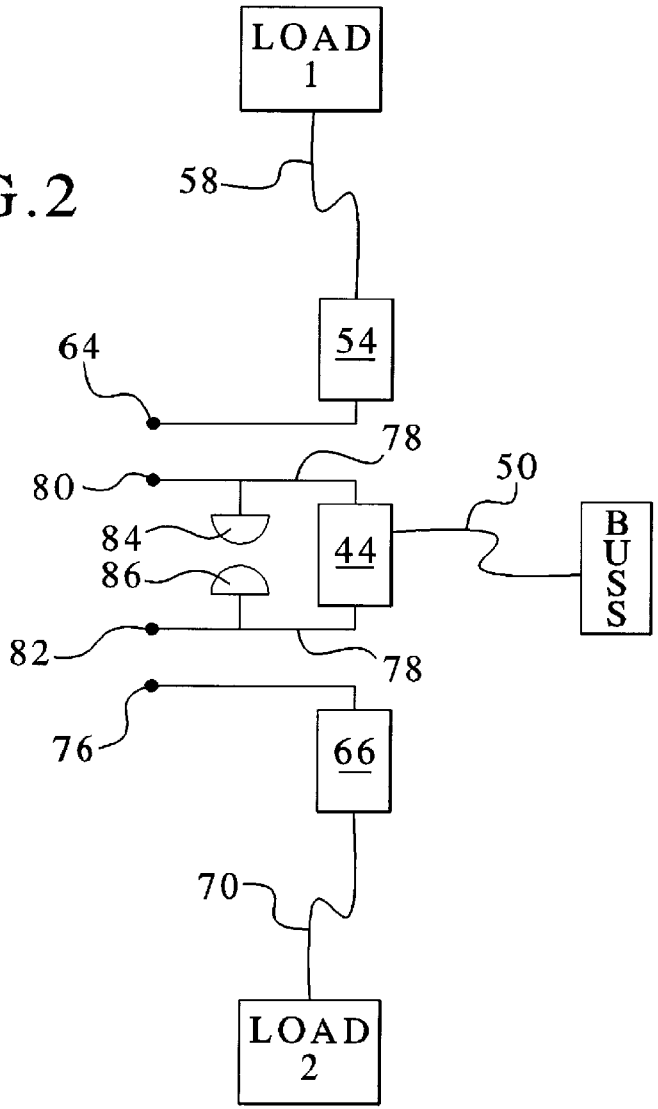
FIG. 2 is a partial schematic, partial block diagram of the electrical circuit formed by the multiple pole fused disconnect of the present invention.

The two LED's illustrated in FIG. 1 electrically communicate with the conductor 78. That is, they electrically connect with the line side of the fused disconnect. Referring one to FIG. 2, a schematic electrical layout illustrates the line wire 50 connecting to the line conductor 44 and the load wires 58 and 70 connecting to the load device conductors 54 and 66, respectively. The line side conductor 78 electrically communicates with the line conductor 44 and the LED indicators 84 and 86. The fuse connectors or clips 64, 80, 82 and 76 receive the contact plugs of the fuse carriers. The load device, conductors 54 and 66 are alternatively adaptable to electrically communicate with the indicators 84 and 86, and in one embodiment, the indicators are alternatively disposed on the load side of the fused disconnect 10.

Figure 3:
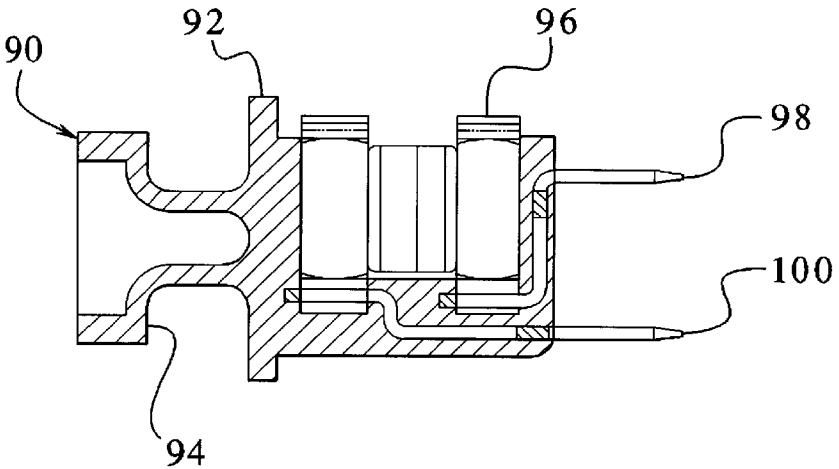
FIG. 3 is an elevation sectional view of one embodiment of the plug-in fuse carrier of the present invention.

Referring now to FIG. 3, one preferred fuse carrier 90 is illustrated. The fuse carrier 90 includes a preferably electrically insulative, flame retardant plastic housing 92, which can be the same material as used for the housing 12 of disconnect 10. The housing 92 defines a handle 94 and provides a slot in which a fuse 96 is removably inserted. The fuse electrically communicates with a pair of plug contacts 98 and 100. The fuse 96 is rated anywhere from one to ninety Å. In another embodiment, the size of the housings 92 and/or the plug spacings can be different in the same disconnect housing. Preferably, the disconnect housing 12 is adapted to receive two fuse carriers 90 having the same sized housing 92 and the same plug contacts 98 and 100 having the same connection footprint.

Figure 4:
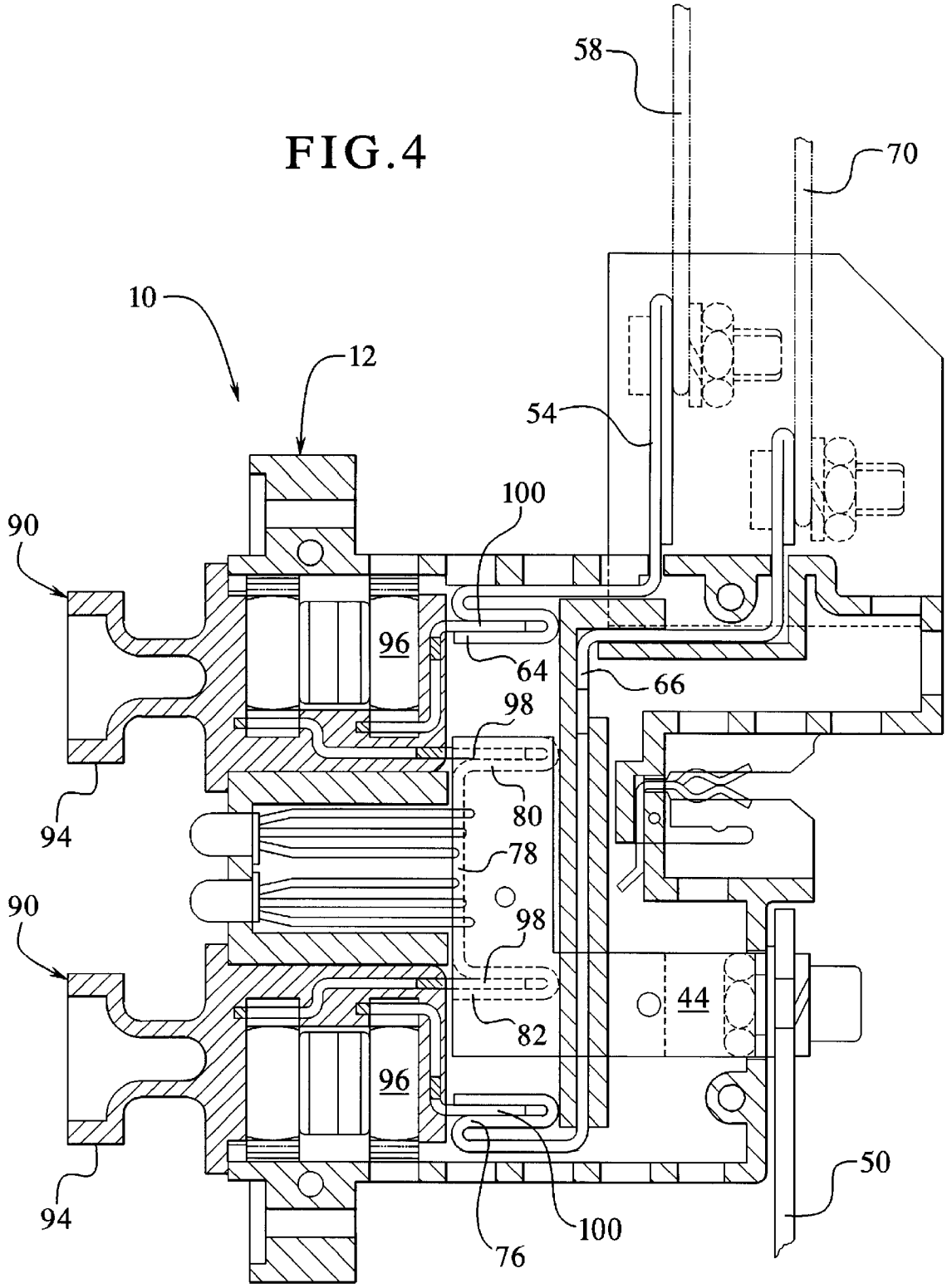
FIG. 4 is an elevation sectional view of one embodiment of the multiple pole fused disconnect of the present invention illustrated in combination with inserted fuse carriers.

Referring now to FIG. 4, the disconnect 10 is illustrated with the fuse carriers 90 inserted into the cavities defined by the housing 12 of the disconnect 10. The operator inserts the carriers 90 via the handles 94. The carriers are oppositely inserted such that the plug contacts 98 of each carrier insert into or electrically communicate with the inside fuse connectors or clips 80 and 82 of the line side conductor 78. The plug contacts 100 of the carriers 90 insert into or electrically communicate with the outside fuse connectors or clips 64 and 76 of the first load conductor 54 and the second load conductor 66, respectively.

It should be appreciated that with the fuse carriers 90 inserted into the disconnect 10, a path of electrical communication exists between the line wire 50, the line conductor 44, the conductor 78, the clip 80, the plug contact 98, the removable fuse 96, the plug contact 100, the clip 64, the first load conductor 54 and the first load wire 58. Removing the fuse carrier 90 from this path creates an interruption in electrical communication between the clips 64 and 80. Likewise, a path of electrical communication exists between the line wire 50, the line conductor 44, the conductor 78, the clip 82, the plug contact 98, the removable fuse 96, the plug contact 100, the clip 76, the second load conductor 66 and the second load wire 70. Removing the fuse carrier 90 from this path creates an interruption in electrical communication between the clips 76 and 82.

It should be understood that various changes and modifications to the presently preferred embodiments described herein will be apparent to those skilled in the art. Such changes and modifications may be made without departing from the spirit and scope of the present invention and without diminishing its attendant advantages.

We claim as our invention:

1. A multiple pole fused disconnect housing, comprising:

a line terminal;

a plurality of load terminals; and a pair of fuse connectors for each load terminal, each pair of fuse connectors adapted to receive a fuse;

wherein the housing is physically dimensioned to require no more mounting space on a standard power distribution frame than does a standard single fuse disconnect housing.

2. The fused disconnect housing of claim 1, wherein the housing has a cavity associated with each pair of fuse connectors and each cavity is adapted to receive a fuse.

3. The fused disconnect housing of claim 2, wherein the fuses are housed in a fuse carrier and each cavity is adapted to receive a fuse carrier.

4. The fused disconnect housing of claim 1, wherein each pair of fuse connectors electrically communicates with the line terminal and one of the plurality of load terminals.

5. The fused disconnect housing of claim 1, wherein one connector of each pair of fuse connectors electrically communicates with a blown fuse indicator.

6. The fused disconnect housing of claim 5, wherein the blown fuse indicator includes a light emitting diode.

7. A multiple pole fused disconnect, comprising:

a housing;

a line terminal secured to the housing;

a plurality of load terminals secured to the housing; and a plurality of fuses, each of the plurality of fuses electrically communicating with the line terminal and a respective one of the plurality of load terminals;

wherein the housing is physically dimensioned to require no more mounting space on a standard power distribution frame than does a standard single fuse disconnect housing.

8. The fused disconnect of claim 7, wherein the line terminal electrically communicates with a blown fuse indicator.

9. The fused disconnect of claim 7, wherein the fuses are housed in a fuse carrier.

10. The fused disconnect of claim 9, wherein the housing has a cavity associated with each fuse, each cavity adapted to receive one of a fuse and a fuse carrier.

11. The fused disconnect of claim 9, wherein the housing has a cavity associated with each fuse, the cavities each adapted to receive identically sized fuse carriers.

12. The fused disconnect of claim 9, wherein the fuse carriers include fused alarm switches in electrical communication with the fuses.

13. The fused disconnect of claim 7, wherein the fuses have different current ratings.

14. The fused disconnect of claim 7, wherein the fuses have current ratings from one to ninety amps.

15. The fused disconnect of claim 7, wherein the fuses include blown fuse indicators.

16. The fused disconnect of claim 7, wherein the housing includes a plurality of pairs of fuse connectors, each pair of fuse connectors adapted to electrically communicate with a fuse.

17. The fused disconnect of claim 7, wherein the housing includes a plurality of pairs of conductive clips, each pair of clips adapted to press-fit onto a pair of fuse contacts associated with the fuse.

18. A method of providing fuse-protected electrical disconnects for a plurality of individual load-side devices in a power distribution system, the method comprising the steps of:

connecting a single industry-standard size electrical disconnect housing to a power distribution frame, the housing including one line terminal and a plurality of load terminals;

connecting a plurality of fuses to the housing, each of the plurality of fuses being in electrical communication between the line terminal and a respective one of the plurality of load terminals;

connecting the line terminal to line-side power; and connecting each of the plurality of load terminals to a respective one of the plurality of individual load-side devices;

wherein a space required along the power distribution frame for the housing is no greater than a space required for a single industry-standard size electrical disconnect housing having one line terminal and only one load terminal and being adapted to connect only one fuse therebetween.

* * * * *